US005986388A

United States Patent [19]

Makishima

[11] Patent Number: 5,986,388

[45] **Date of Patent: *Nov. 16, 1999**

[54] FIELD-EMISSION COLD-CATHODE ELECTRON GUN HAVING EMITTER TIPS BETWEEN THE TOP SURFACE OF GATE ELECTRODE AND FOCUSING ELECTRODE

[75] Inventor: Hideo Makishima, Tokyo, Japan

[73] Assignee: NEC Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/920,508

[22] Filed: Aug. 29, 1997

[30] Foreign Application Priority Data

Aug. 30, 1996 [JP] Japan ..... 8-230597

[51] Int. Cl.[6] ..... H01J 1/02

[52] U.S. Cl. ..... 313/309; 313/336; 313/351; 313/495

[58] Field of Search ..... 313/309, 336, 313/351, 495

[56] References Cited

U.S. PATENT DOCUMENTS

| | | | |
|---|---|---|---|
| 4,780,684 | 10/1988 | Kosmahl | 330/54 |
| 5,191,217 | 3/1993 | Kane et al. | 313/336 |
| 5,363,021 | 11/1994 | MacDonald | 315/366 |
| 5,550,435 | 8/1996 | Kuriyama et al. | 313/336 |
| 5,559,389 | 9/1996 | Spindt et al. | 313/310 |
| 5,576,594 | 11/1996 | Toyoda et al. | 313/336 |
| 5,578,900 | 11/1996 | Peng et al. | 313/309 |
| 5,680,011 | 10/1997 | Makishima | 313/309 |
| 5,786,657 | 7/1998 | Okamoto | 313/309 |

FOREIGN PATENT DOCUMENTS

| | | |
|---|---|---|
| 430561 | 6/1991 | European Pat. Off. . |
| 2737041 | 1/1997 | France . |
| 3-187127 | 8/1991 | Japan . |
| 6-349414 | 12/1994 | Japan . |
| 92 09095 | 5/1992 | WIPO . |

OTHER PUBLICATIONS

Kosmahl, Henry, "A Wide–Bandwidth High–Gain Small–Size Distributed Amplifier with Field–Emission Triodes (FETRODE'S) for the 10 to 300 GHz Frequency Range", *IEEE* Transactions on Electron Devices, vol. 16, No. 11, Nov. 1989.

Spindt, et al., "Progress in Field–Emitter Array Development for High Frequency Operation", *Proceedings of the International Electron Devices Meeting*, Washington, Dec. 5–8, 1993, pp. 749–752, Institute of Electrical and Electronics Engineers.

M. Arai, et al., "High Efficiency Microwave Multiplier Using A Field Emittion Array", Technical Report of IEICE, ED93–142, (Dec. 1993), pp. 55–60.

C.A. Spindt, "A Thin–Film Field–Emission Cathode", J. Applied Physics, vol. 39, No. 7, Jun. 1968, pp. 3504–3505.

N.E. McGruer, et al., "Vacuum Microelectronic Microstrip Amplifier Design", Technical Digest of IVMC 89, p. 8–3.

N.E. McGruer, et al., "Field Emitter Structures in Microwave Generation and Amplification", Technical Digest of IVMC 91, pp. 68–69.

W.L. Ohlinger, et al., "Beam Deflection Concept for A Vacuum Microelectronic Microwave Aplifier", Technical Digest of IVMC 91, pp. 110–111.

C.E. Holland, et al., "Progress In Field–Emitter Development for Gigahertz Operation", Technical Digest of IVMC 93, pp. 148–149.

*Primary Examiner*—Vip Patel

*Attorney, Agent, or Firm*—Ostrolenk, Faber, Gerb & Soffen, LLP

[57] ABSTRACT

A field-emission cathode comprises a substrate having a conductive surface, a gate electrode and a focusing electrode overlying the substrate with insulation layers interposed therebetween, a plurality of cavities formed by penetrating the gate electrode, focusing electrode and insulation layers, and an emitter formed in each of the cavities on the substrate for emission of an electron beam. The emitter has tip located at a level between the gate electrode and the focusing electrode, which receive therebetween a signal for modulating the electron beam at a high frequency.

7 Claims, 11 Drawing Sheets

FIELD-EMISSION COLD-CATHODE ELECTRON GUN HAVING EMITTER TIPS BETWEEN THE TOP SURFACE OF GATE ELECTRODE AND FOCUSING ELECTRODE

BACKGROUND OF THE INVENTION (a) Field of the Invention

The present invention relates to a field-emission cold-cathode electron gun having a plurality of micron-sized cathodes formed by thin-film technology to provide a density-modulated electron beam, and an electron-beam device, such as a cathode ray tube (CRT) or a microwave tube, having the devised electron gun.

(b) Description of the Related Art

A field-emission cold-cathode (or field-emission cathode) is proposed by C. A. Spindt, et al., in which a plurality of minute cathodes are arranged in an array, each of the cathodes including a plurality of micron-sized conical emitters and a controlling electrode or a gate electrode formed in the vicinity of the emitters and having an electron-pulling function from the conical emitters and a current-controlling function (C. A. Spindt, "A Thin-Film Field-Emission Cathode", Journal of Applied Physics, Vol. 39, No. 7, pp. 3504, 1968).

FIG. 1A is a partially-broken perspective view showing the structure of the proposed field-emission cathode (hereinafter referred to as a "Spindt-type cathode"), and FIG. 1B is a cross-sectional view of one of the minute cathodes 107 constituting the Spindt-type cathode as a whole. With reference to FIGS. 1A and 1B, an insulation layer 102 of silicon-oxide is formed on a silicon substrate 101, and a gate electrode 103 is formed on the insulation layer 102. The insulation layer 102 and the gate electrode 103A are selectively removed to form a plurality of cavities 109, in each of which a conical emitter 104 having a pointed tip is formed. The minute cathode 107 is formed by an emitter 104, gate electrode 103 and a corresponding cavity 109. The Spindt-type cathode 108 is composed of a plurality of minute cathodes 107 arranged in an array to form a planar electron emission region.

The substrate 101 and the emitters 104 are electrically connected together, and a voltage of approximately 50 volts is applied between the emitters 104 and gate electrode 103. Since the thickness of the insulation layer 102, the diameter of the openings in the gate electrode 103 and the tip diameter of the emitter 104 are as low as approximately 1 $\mu$m, 1 $\mu$m and 10 nm, respectively, a strong electric field is generated around the tips of the emitters 104. When the strength of the electric field around the tip of the emitter 104 ranges between $2\times10^7$ and $5\times10^7$ volts/cm or above, electrons are emitted from the tips of the emitters 104. A planar-cathode (field-emitter-array: FEA) capable of emitting a large electron current is constructed by arranging the minute cathodes 107 on the substrate 101 in an array. A density of the cathode current as high as 5 to 10 times that of a conventional thermionic cathode can be attained by the FEA in which the minute cathodes 107 are arranged at a high density by using fine-processing technology.

Advantages of the Spindt-type cathode include: a higher density of the cathode current and a smaller velocity distribution of the emitted electrons compared to those of a thermionic cathode; a smaller noise current compared to that of a single field-emission cathode; and capability of operation with a relatively low voltage as low as several volts to several tens of volts and in a relatively poor vacuum environment.

The Spindt-type cathode may also be implemented by additionally forming a focusing electrode 106 over the gate electrode 103 spaced therefrom by another insulation layer 105, as illustrated in FIG. 1C. In this configuration, the focusing electrode 106 converges the electrons emitted from the emitters 104 on an electron path.

If the Spindt-type cathode is employed in an image receiving tube (cathode ray tube or CRT), there is a possibility that a high resolution can be achieved, because of high density of the cathode current, with less power dissipation because of the absence of a heater. Alternatively, if it is applied to a microwave tube such as a travelling wave tube (TWT) or a Klystron, a highly compact and efficient device can be expected by taking advantages of the field-emission cathode. However, in order to employ the Spindt-type cathode in a CRT or microwave tube, it is important to reduce the parasitic capacitance between the gate and emitters to thereby enhance the operable frequency in electron beam modulation. There have been presented many proposals for this purpose.

The first of the proposals is directed to a structure shown in FIG. 2, for instance, wherein emitters 201 are arranged in a row to thereby reduce overlapping areas between gate electrodes 202 and cathode electrodes 203 having emitters 201 thereon (C. E. Holland et al., "Progress in Field-Emitter Development for Gigahertz Operation", IVMC '93 Technical Digest, p.148-149, 1993). The second of the proposals is directed to a structure in which each of the emitters is surrounded by an annular gate electrode while the emitters are connected together with fine interconnects and floated in the vacuum space (H. G. Kosmahl, "A Wide-Bandwidth High-Gain Small-Sized Distributed Amplifier with Field-Emission Triodes (FETRODE's) for the 10 to 300 GHz Frequency Range", IEEE Trans. ED, Vol. 36, No. 11, p 2728–2737, 1989).

The third of the proposals is directed to a micro-strip amplifier, as illustrated in FIG. 3, which comprises input-side and output-side micro-strip line pairs 304 and 305, the input-side micro-strip line pair 304 being implemented by a ground plate 302 of an insulation plate 301 and a grid 303, the output-side micro-strip line pair 305 overlying emitters (not illustrated) extending from the ground plane 302 toward the grid 303 (N. E. McGruer et al., "Field Emitter Structures in Microwave Generation and amplification", IVMC '91 Technical Digest, p.68–70, 1991; IEEE Trans. ED, Vol. 38, No. 3, p.666–671, 1991). In this configuration, an RF voltage is induced as an output corresponding to the electrons emitted from the emitters.

The fourth of the proposals is directed to a structure wherein areas for a gate electrode, a bonding pad and interconnections between the gate electrode and the bonding pad are reduced to the minimum, to increase the thickness of insulation layers for the bonding pad and the interconnections.

On the other hand, there have been presented other proposals for enabling a FEA to operate at a higher frequency substantially without being affected by the parasitic capacitance between the gate and emitters. The first of them is directed to a structure wherein an FEA is provided at the terminal of a micro-strip line, as shown in FIGS. 4A (cross-sectional view) and 4B (top plan view), proposed by Arai et al., in "A High-Efficiency Microwave Amplifier Provided with an Array of Field-Emission Cathodes", Technical Report, Society of Communication Technology, ED 93–142, 1993-12. In the proposed structure, a resonator is implemented by a micro-strip line 401, and the capacitor of the resonator is implemented by the parasitic capacitance formed between the gate and emitters of the FEA 402.

The second of the other proposals is directed to a density-modulated electron gun wherein FEA 501 is received in a cavity resonator 502 which is resonant with an input signal, as shown in FIG. 5A (overall cross-sectional view) and FIG. 5B (partial cross-sectional view). The tips of the emitters 104 in the FEA 501 have an electric field produced by a DC voltage applied between the gate electrode 103 and emitters 104, superimposed by another electric field produced by the input RF signal generated in the cavity resonator, to thereby modulate the emission amount of electrons (JP-A-61994-349414. In FIG. 15A). A reference numeral 503 denotes an input terminal, 504 anodes, VA and VGE power sources for the anodes and cathodes, respectively.

The third of the other proposals is directed to a Klystron (JP-A-3(1991)-187127), wherein a density-modulated electron beam is produced by allowing the electron beam released from emitters 601 to pass through an input micro-strip line 602 for velocity-modulation and by allowing the resultant electron-beams to pass through a drifting section 603 for density modulation. FIG. 6A illustrates the structure of the proposed Klystron, and FIG. 6B illustrates a part thereof in the vicinity of the electron gun.

Among the above-described conventional technologies, the structure of FIG. 2 cannot provide an electron beam having a circular cross-section, which is requested in general electron-beam devices such as CRTs, TWTs and Klystrons. Further, the experiments so far conducted have revealed that the maximum modulation frequency attained by the structure remains as low as approximately 2 GHz. The electron-beam modulator shown in FIG. 3 can hardly provide an electron beam having a circular cross-section as well. There also arise many difficulties in fabricating emitters having a larger height at a high precision, and also in fabricating such emitters at a high density within a limited area. In short, these structures proposed to reduce the parasitic capacitance between the gate and emitters involve great difficulties because of the particular structures of the emitters and gate, while providing limited advantages.

In the electron-beam modulation shown in FIGS. 4A and 4B, only a relatively narrow resonant frequency band is attainable due to the large parasitic capacitance of the micro-strip line resonator involved between the gate and emitters of the FEA, which increases in proportion to the area of the cathode. That is, the proposed structure is not suitable for appliances of a high output power since the maximum current available in the form of the electron beam is limited.

In the electron-beam modulation shown in FIGS. 5A and 5B, it involves a problem of a relatively large size of the appliances employing the electron gun of the proposed structure, because of the physical size of the cavity resonator itself. Further, in the structure shown in FIGS. 6A and 6B, since the electron beam is velocity-modulated and then density-modulated by allowing the electron beams to pass in the drifting section which provides a significant travel length of electrons to obtain a sufficient modulation for the electron beam, a problem of large size in the appliances also arises.

SUMMARY OF THE INVENTION

It is an object of the present invention to provide a field-emission cathode electron gun which is compact in size and capable of operating at a high frequency up to around 20 GHz, for example, and also to provide an electron beam device having such a field-emission cathode electron gun.

The present invention provides a field-emission cathode electron gun comprising: a substrate having a conductive surface; a first insulation film, a gate electrode, a second insulation film and a focusing electrode consecutively formed on the conductive surface and defining a plurality of cavities therein; and an emitter formed on the conductive surface in each of the cavities to emit an electron beam from a tip of the emitter, the tip of the emitter being disposed at a level between a bottom surface of the gate electrode and the focusing electrode, the gate electrode and focusing electrode receiving therebetween a signal for modulating the electron beam.

In accordance with the field-emission cathode electron gun according to the present invention, the electron beam can be modulated at a high frequency without requiring a special structure for the gate electrode or the focusing electrode because of the specific arrangement wherein the tips of the emitters are disposed between the bottom of the gate electrode and the focusing electrode.

The field-emission cathode electron gun according to the present invention can provide a compact electron beam device with less power-dissipation. Especially when employed in a CRT, for example, a display unit having an excellent resolution with a large number of picture elements can be obtained. Further, when employed in a microwave tube such as a TWT or a Klystron, a compact microwave amplifier or oscillator having a high operable frequency and DC-FR conversion efficiency can be realized.

The above and other objects, features and advantages of the present invention will be more apparent from the following description, referring to the accompanying drawings.

DESCRIPTION OF THE PREFERRED EMBODIMENTS,

Now, the present invention is more specifically described with reference the accompanying drawings.

Figure 1A:
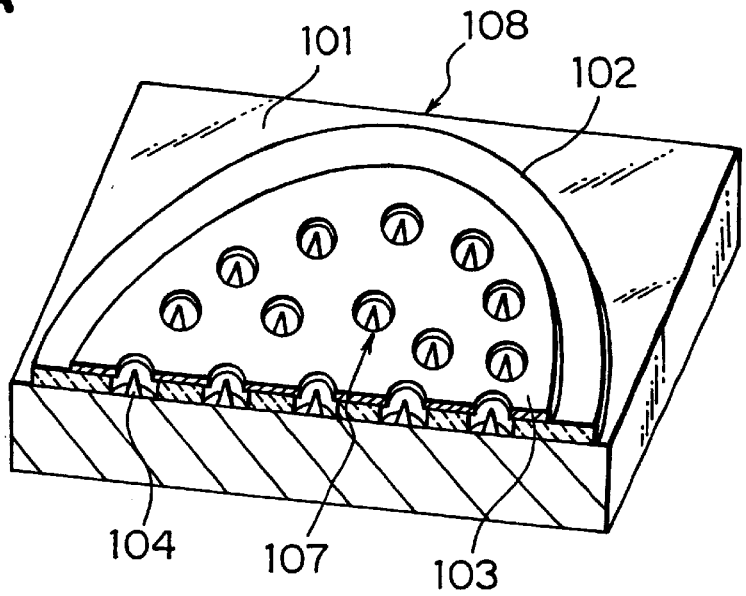
FIG. 1A PRIOR ART
FIGS. 1A and 1B are a partially-broken perspective view and a cross-sectional view, respectively, of a conventional Spindt-type cathode.
Figure 1B:
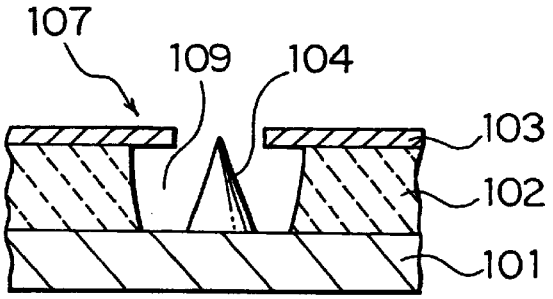
FIG. 1B PRIOR ART
Figure 1C:
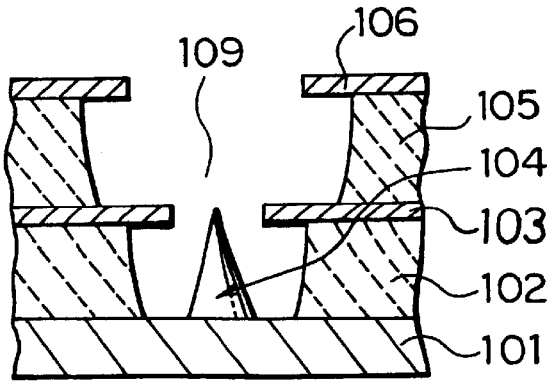
FIG. 1C PRIOR ART
FIG. 1C is a cross-sectional view of a modification of the Spindt-type cathode of FIGS. 1A and 1B.
Figure 2:
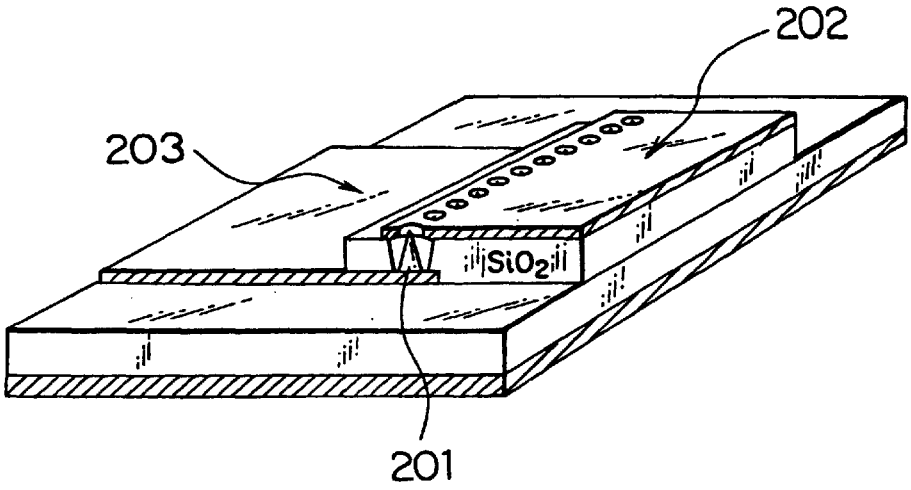
FIG. 2 PRIOR ART
FIG. 2 is a perspective view of another conventional field-emission cathode.
Figure 3:
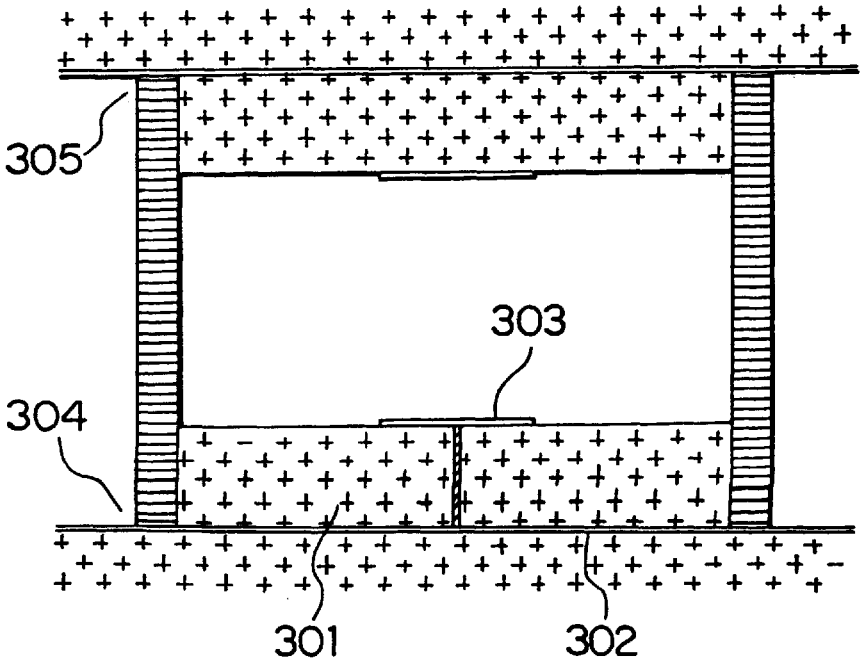
FIG. 3 PRIOR ART
FIG. 3 is a cross-sectional view of another conventional field-emission cathode.
Figure 4A:
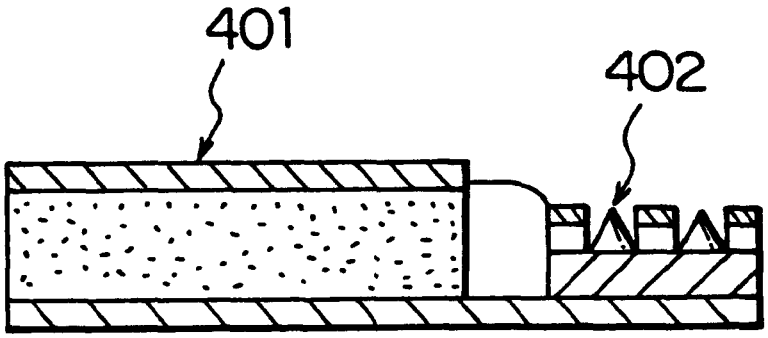
FIG. 4A PRIOR ART
FIGS. 4A and 4B are a cross-sectional view and a top plan view, respectively, of the structure of a conventional field-emission cathode electron gun.
Figure 4B:
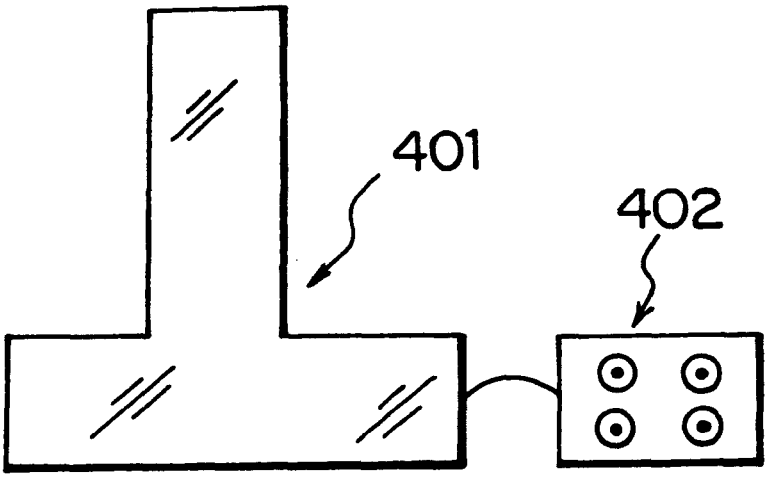
FIG. 4B PRIOR ART
Figure 5A:
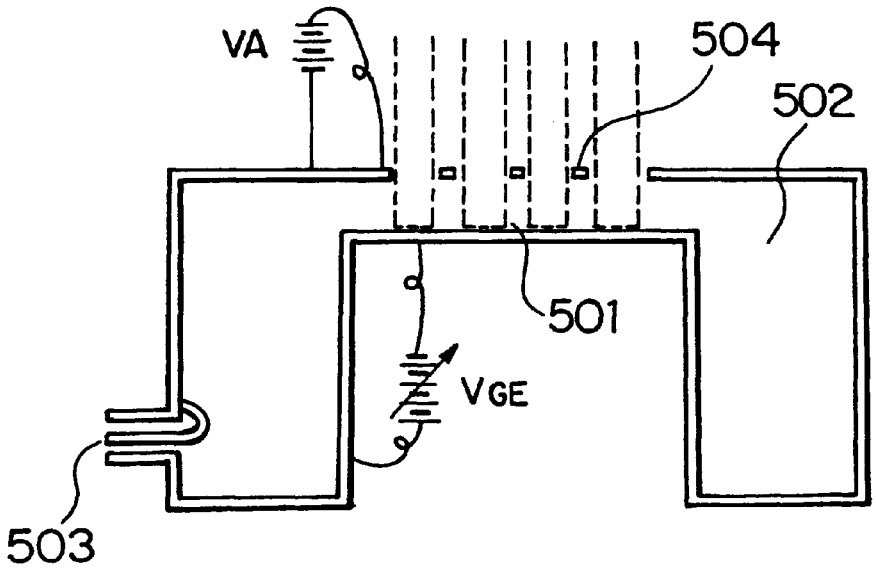
FIG. 5A PRIOR ART
FIGS. 5A and 5B are a cross-sectional view and an enlarged partial cross-sectional view, respectively, of a conventional density-modulated electron gun.
Figure 5B:
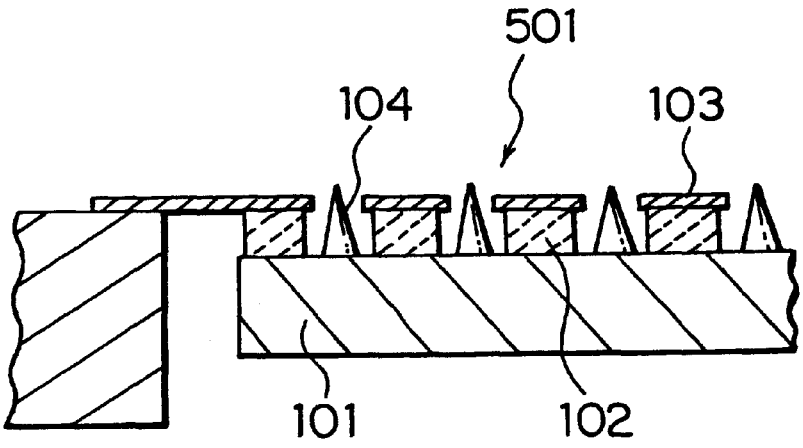
FIG. 5B PRIOR ART
Figure 6A:
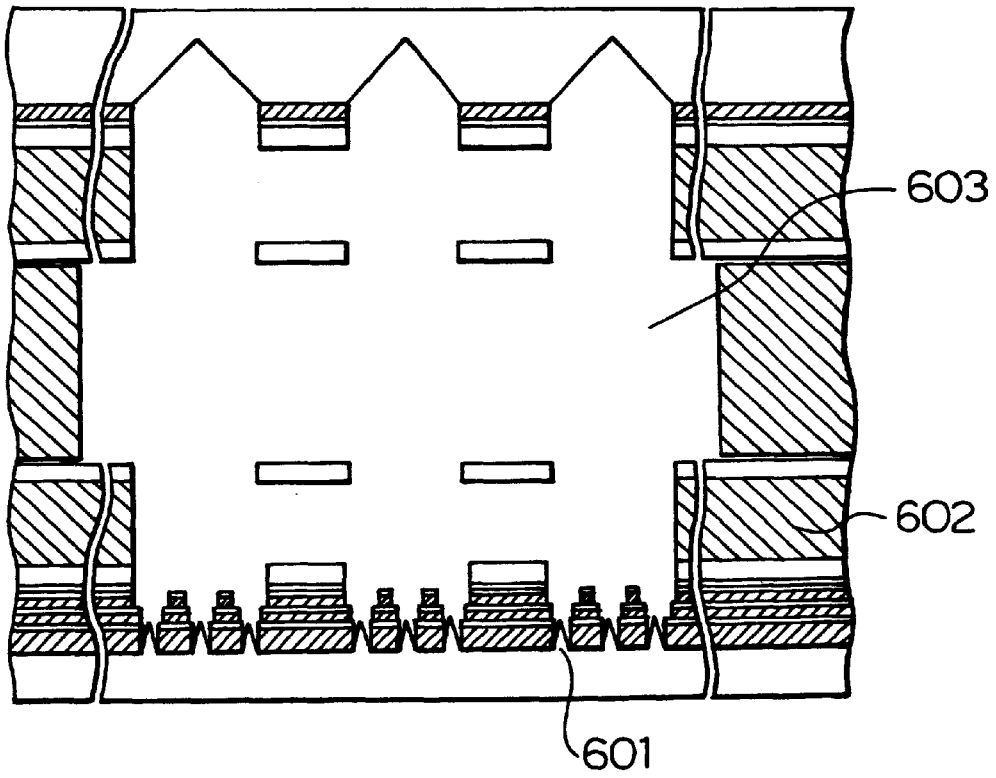
FIG. 6A PRIOR ART
FIGS. 6A and 6B are a cross-sectional view and an enlarged perspective view, respectively, of a conventional Klystron.
Figure 6B:
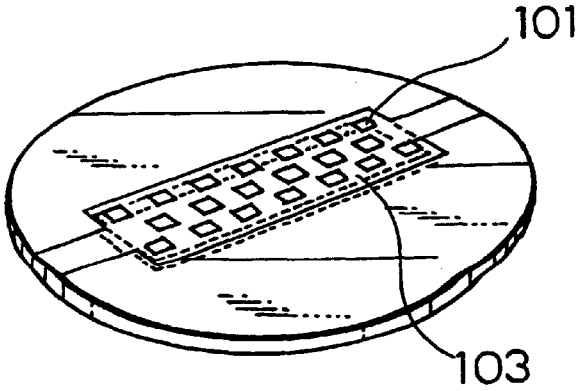
FIG. 6B PRIOR ART
Figure 7:
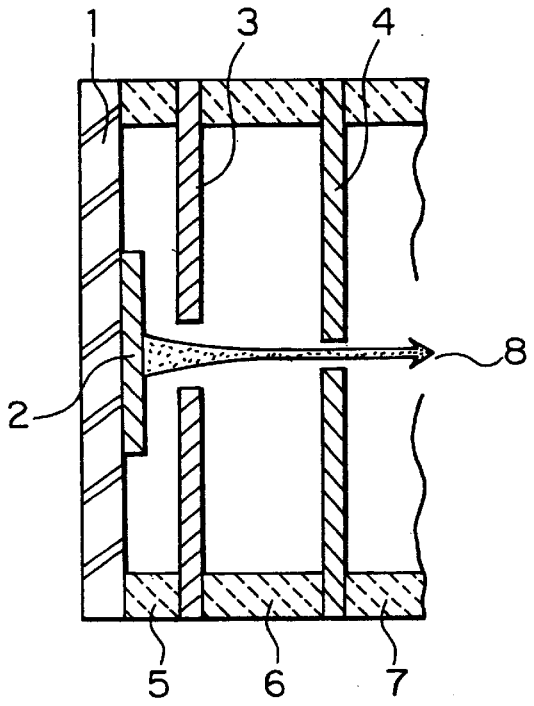
FIG. 7 is a cross-sectional view of the fundamental structure of a field-emission cathode electron gun according to a first embodiment of the present invention.

Referring to FIG. 7 showing a field-emission cathode electron gun according to a first embodiment of the present invention, a field-emission cathode 2 is disposed at the central part of an insulating substrate 1 of a disk shape. The cathode 2 has a DC-voltage and an input signal from outside applied via interconnections not shown in the figure. First and second annular electrodes 3 and 4 overlying the field-emission cathode 2 are separated from each other and from other parts by first to third cylindrical insulators 5, 6 and 7 having a predetermined height. The first and second electrodes 3 and 4 converge electrons taken out from the field-emission cathode 2 to accelerate the electrons to form an electron beam 8. The first to third insulators 5, 6 and 7 function as a housing for maintaining the inside thereof at a vacuum.

Figure 8:
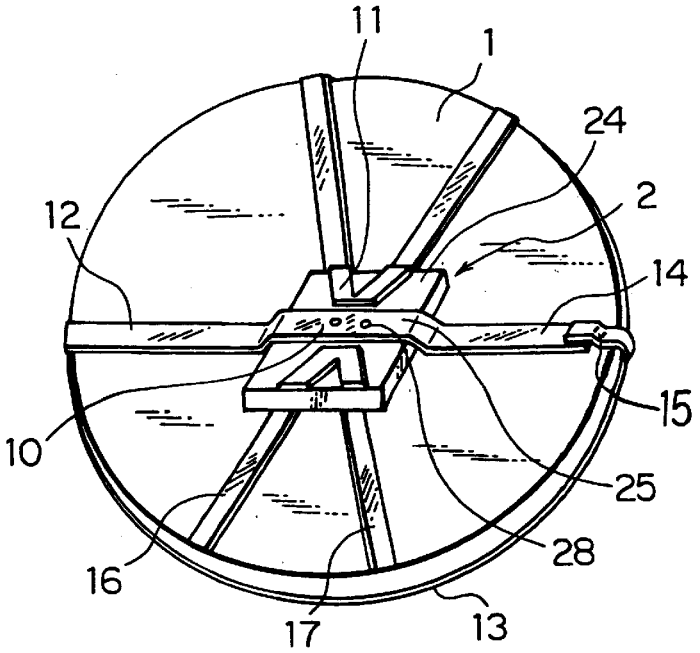
FIG. 8 is a perspective view of the field-emission cathode shown in FIG. 7.
Figure 9:
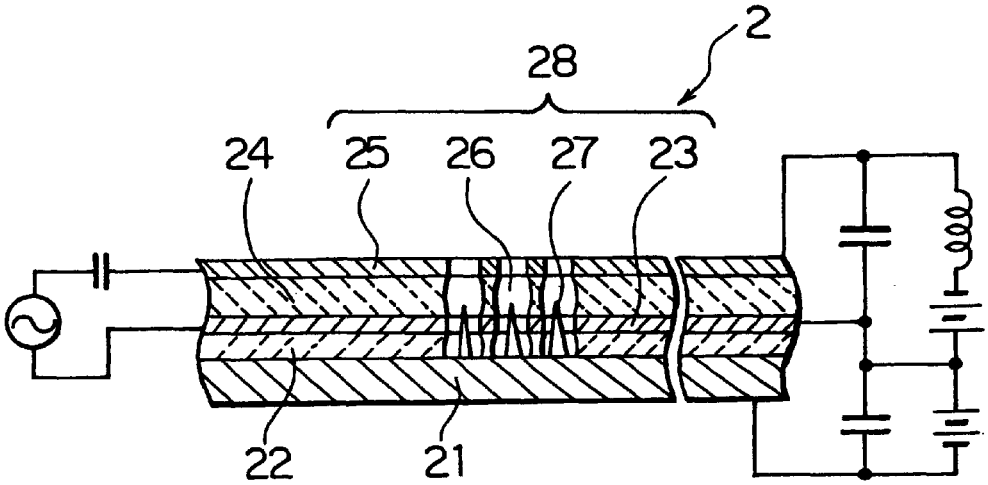
FIG. 9 is a cross-sectional view of the field-emission cathode shown in FIG. 7.

FIGS. 8 and 9 show the details of FIG. 7, illustrating the arrangement of the insulating substrate 1 and the cathode 2 and the structure of the cathode 2, respectively. In FIG. 9, the field-emission cathode (cathode assembly) 2 comprises a cathode substrate 21, and a first insulation layer 22, a gate electrode 23, a second insulation layer 24, focusing electrode 25 and a dummy pattern (not shown in the figure and will be described later), which are consecutively formed on the cathode substrate 21 to form a laminate. A plurality of cavities 26 are formed by selectively removing the first insulation layer 22, gate electrode 23, second insulation layer 24 and focusing electrode 25. On the cathode substrate 21 at the bottom of each cavity 26, a micron-sized emitter 27 is disposed. The cathode substrate 21 and the emitters 27 are electrically connected together. Each emitter 27, a corresponding opening of the gate electrode 23 and a corresponding opening of the focusing electrode 25 constitute an individual minute cathode 28, and an array of the individual minute cathodes 28 implement an electron-emitting region 10 of the cathode assembly 2 shown in FIG. 8.

Referring to FIG. 8, the cathode assembly 2 is disposed at the central part of the insulating substrate 1. The focusing electrode 25 is formed as a stripe pattern extending over the insulating substrate 1 and the cathode assembly 2, and the individual minute cathodes 28 are formed in a part of the focusing electrode 25. The focusing electrode 25 and the gate electrode 23 constitute a micro-strip line pair, or a distributed parameter transmission line pair, in which the gate electrode 23 functions as a ground electrode. The dummy pattern 11 formed on the cathode assembly 2 as well as the focusing electrode 25 is formed to be roughly point-symmetric with respect to the center of the electron-emitting region 10. By this configuration, when approximately equal DC voltages are applied to the dummy pattern 11 and the focusing electrode 25, an electric field is formed having an excellent axial symmetry with respect to the axis of the electron beam extending perpendicularly to the insulating substrate 1 at the center of the electron-emitting region 10. The second insulation layer 24 separates the underlying gate electrode 23 and the focusing electrode 25 along with the dummy pattern 11 overlying the second insulation layer 24.

An input strip line 12 is formed on the insulating substrate 1, is connected with the focusing electrode 25, forms a micro-strip line pair, or a distributed parameter transmission line pair, together with a rear electrode 13 provided on the rear surface of the insulating substrate 1, and receives a RF signal from outside. The rear electrode 13 is connected with the gate electrode 23. An output strip line 14 is also formed on the insulating substrate 1, is connected with the focusing electrode 25, and forms another micro-strip line pair together with the rear electrode 13. The length of the output strip line 14 as viewed from the electron-emitting region 10 is set at ¼ wavelength of the RF signal, the terminal of the output strip line 14 being connected with the rear electrode 13 through a capacitor 15 to form an RF ground line. In FIG. 8, a cathode line 16 and a dummy line 17 supply voltages to the emitters 27 and the dummy pattern 11, respectively.

Figure 10:
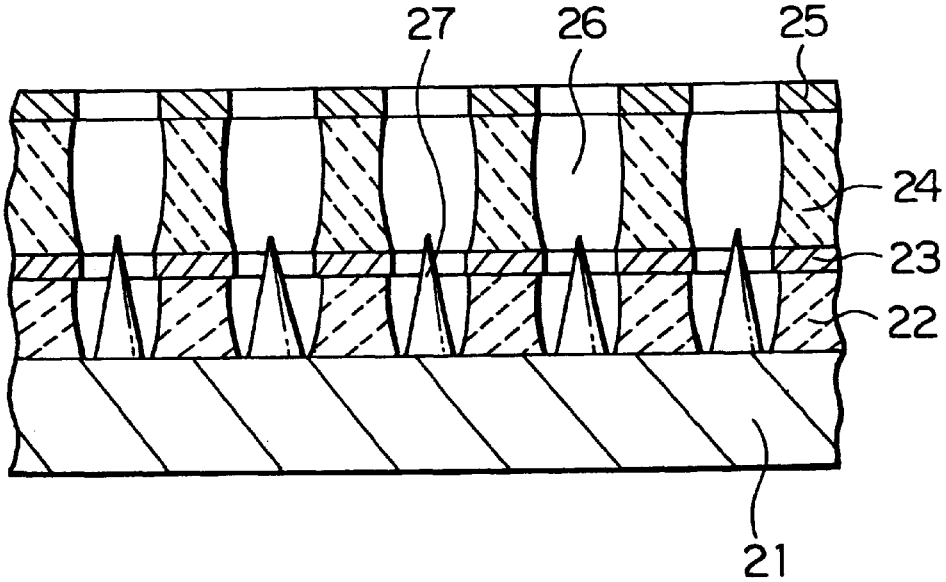
FIG. 10 is an enlarged partial cross-sectional view of the field-emission cathode shown in FIG. 7.

In the cathode assembly 2, as shown in the enlarged cross-sectional view of FIG. 10, each of the conical emitters 27 disposed on the cathode substrate 21 in a corresponding cavity 26 has a tip located at a level between the focusing electrode 25 and the gate electrode 23, extending beyond the top surface of the first insulation layer 22. It is sufficient that the conical emitter 27 has a height larger than the thickness of the first insulation layer 22.

The conical emitters 27 are made of a refractory metal such as tungsten or molybdenum, the gate electrode 23 and focusing electrode 25 are made of a metal or metallic compound such as tungsten, molybdenum, niobium or tungsten-silicide, and the first and second insulation layers 22 and 24 are made of a single-layer structure or laminate structure of silicon oxide and/or silicon nitride. The diameter of the openings in the gate electrode 23 is approximately 1 $\mu$m, the height of the emitters 27 is approximately 0.5 to 1 $\mu$m, the thickness of the first insulation layer 22 is approximately 0.4 to 0.8 $\mu$m, the thickness of the second insulation layer 24 is approximately 1 to 3 $\mu$m and the thickness of the gate electrode 23 and focusing electrode 25 is approximately 0.2 $\mu$m.

To manufacture the cathode assembly 2, the cavities 26 in the gate electrode 23, focusing electrode 25 and the first and second insulation layers 22 and 24 are first formed, then a sacrificial layer is deposited in an oblique direction on a wafer while the wafer is rotated, and the emitters are deposited in the direction perpendicular to the wafer, as described in the literature, for instance, Journal of Applied Physics, Vol. 39, No. 7, pp.3504, 1968.

To operate the cathode electron gun of the present embodiment, as shown in FIG. 9, a negative DC voltage of approximately ten to several tens of volts is applied to the cathode substrate 21 with respect to the gate electrode 23 while applying a negative voltage to the focusing electrode 25 with respect to the gate electrode 23. Voltages of the gate electrode 23 and focusing electrode 25 are adjusted to set an emission current slightly above zero during the absence of the RF signal, or adjusted to values adjacent thereto. The RF signal is transmitted from the vacuum reservoir (not illustrated) held in a vacuum to the input strip line 12 on the insulating substrate 1. Since the input strip line 12, together with the rear electrode 13, constitutes a micro-strip line pair, the input strip line 12 and rear electrode 13 are connected to the focusing electrode 25 and gate electrode 23, respectively, in the cathode 2 which constitute another micro-strip line.

When the RF signal is input between the gate electrode 23 and the focusing electrode 25, an RF electric field, superimposed with a DC electric field generated by the DC voltage applied between the emitters 27 and both the gate electrode 23 and the focusing electrode 25, is generated around the tips of the emitters 27.

In the above-described first embodiment, the emitters 27 extend beyond the gate electrode 23 toward the focusing electrode 25, and the RF input signal is applied between the gate electrode 23 and the focusing electrode 25, which have a dimensional margin substantially without being affected in the emission characteristic thereof, to be transmitted via the micro-strip line. Accordingly, a direct modulation of the electron beam by the RF signal can be attained at a high frequency without being affected by the gate-emitter parasitic capacitance, and excellent characteristics can be realized in the high frequency range. Further, the dummy pattern provides an electric field of an excellent axial symmetry for formation of electron beam, thereby reducing deformation of the shape of the electron beam spot to avoid superimposed distortion in the deflection patterns.

It is also possible to form individual emitters 27, gate electrode 23, focusing electrode 25 and interconnections for connection of these electrodes with external terminals directly on the insulating substrate 1, instead of laying the cathode assembly 2 on the insulating substrate 1.

Figure 11A:
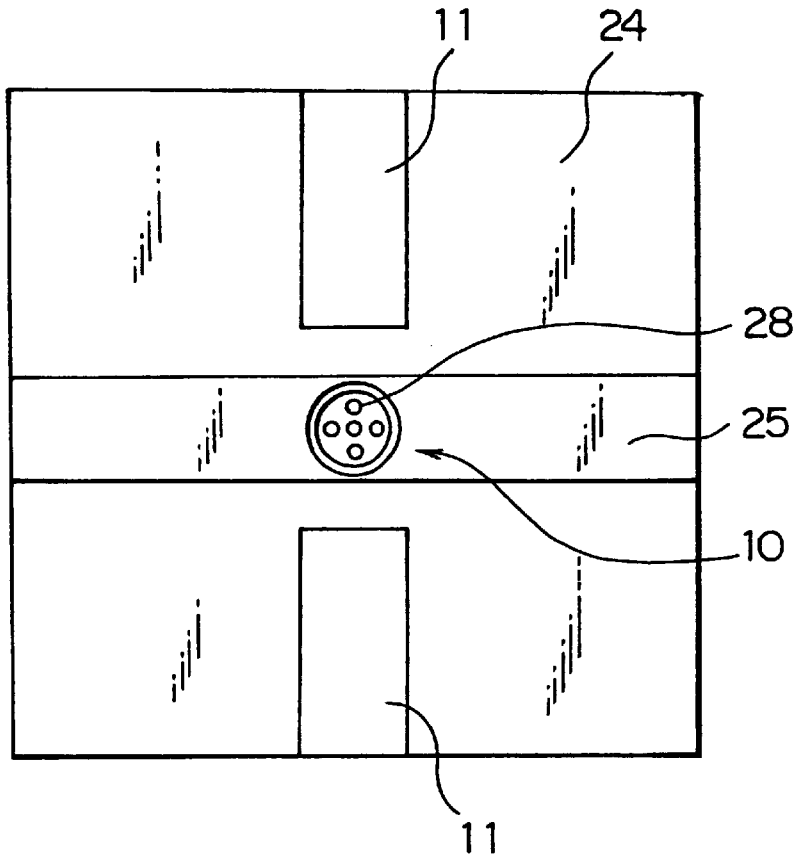
FIGS. 11A and 11B are a top plan view and a cross-sectional view, respectively, of a field-emission cathode according to a second embodiment of the present invention.
Figure 11B:
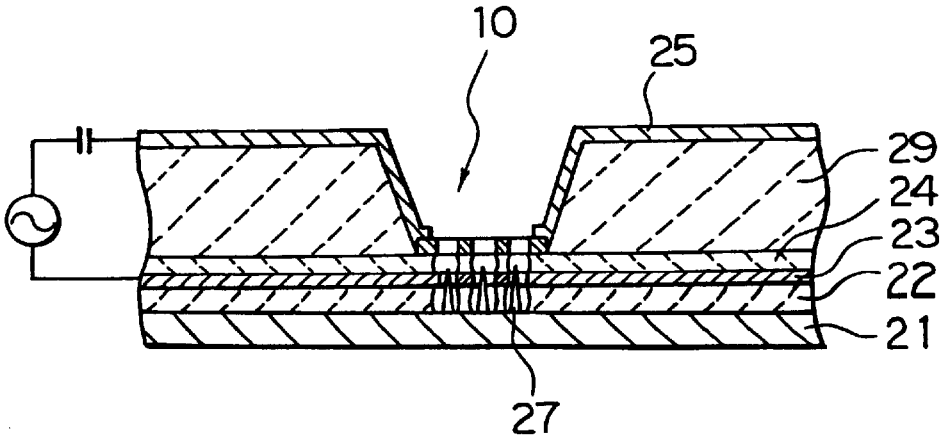

Referring to FIGS. 11A and 11B showing a field-emission cathode in a cathode electron gun according to a second embodiment of the invention, the present embodiment is similar to the first embodiment except for a third insulation layer 29 provided in the second embodiment. Specifically, the third insulation layer 29 having a sufficient thickness is provided between the bottom surface of the focusing electrode 25 and the top surface of the second insulation layer 24, in a region other than the electron emitting region 10 where the minute cathodes 28 are formed, for exposing the minute cathodes 28. The RF signal is applied between the gate electrode 23 and focusing electrode 25 in the electron emitting region 10, substantially without a loss of its higher frequency components. Since the gap between the gate electrode 23 and focusing electrode 25 in the electron emitting region 10 is smaller than that of other parts, a strong RF electric field is generated around the tips of the emitters 27.

Figure 12:
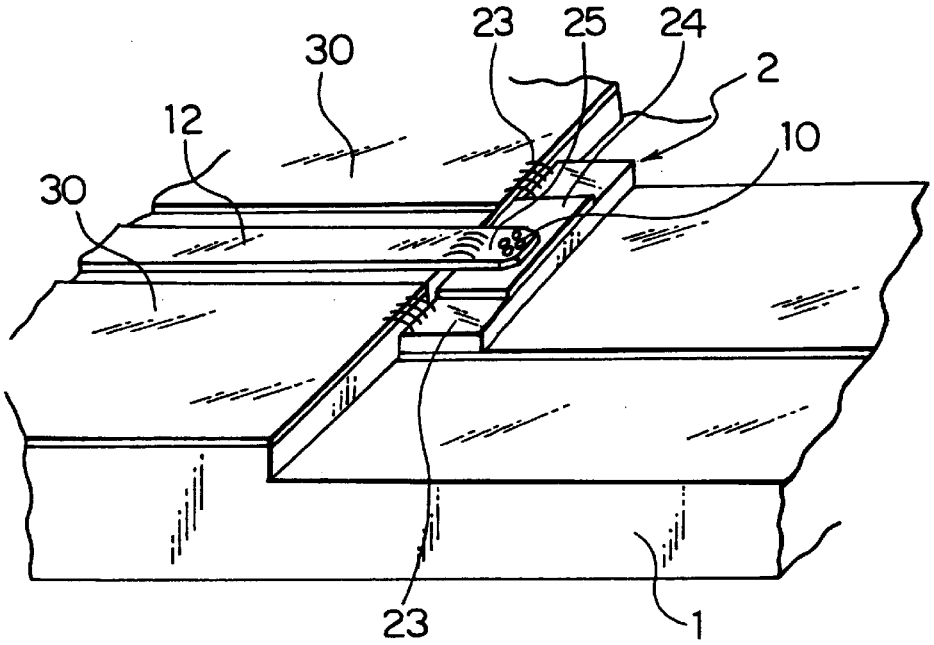
FIG. 12 is a perspective view of a field-emission cathode according to a third embodiment of the present invention.

Referring to FIG. 12 showing a field-emission cathode in a cathode electron gun according to a third embodiment of the present invention, a co-planar line pair is formed as a distributed parameter transmission line pair, which includes a strip line 12 as a central conductor and gate electrode lines 30 disposed on both sides of the central conductor 12 as a ground conductor. The input RF signal is transmitted via the co-planar line pair to be applied between the gate electrode 23 and focusing electrode 25 in the cathode assembly 2. The gate electrode 23 is connected to the gate electrode lines 30 at both sides of the electron emitting region 10. A step portion having a height equal to the overall thickness of the field-emission cathode 2 is formed on the surface of the insulating substrate 1. The focusing electrode 25 and gate electrode 23 are connected with the input strip line 12 and gate electrode lines 30, respectively, substantially on the same plane. A suitable impedance-matching element (not illustrated in the figure) is inserted in the co-planar line to match the co-planar line pair with the RF signal.

Figure 13:
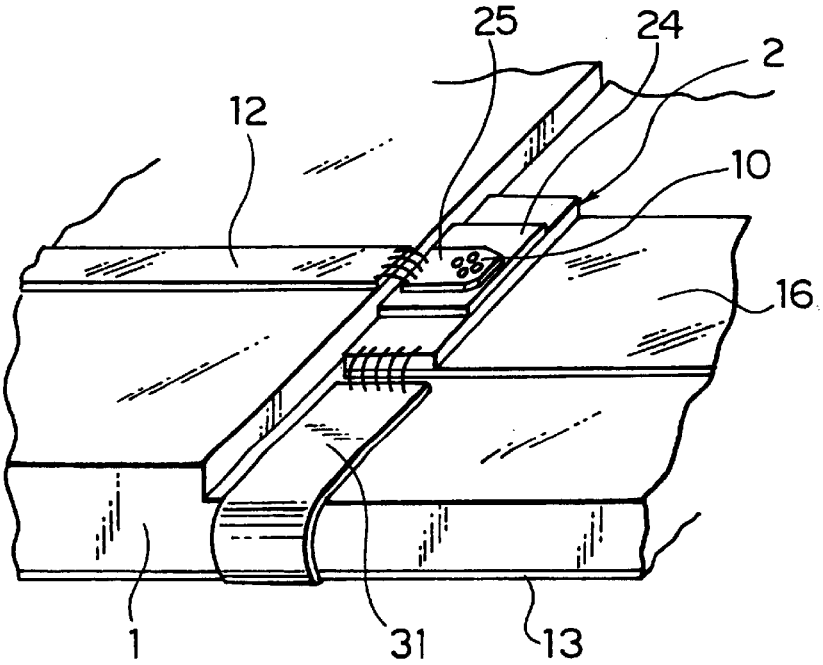
FIG. 13 is a perspective view of a field-emission cathode according to a fourth embodiment of the present invention.

Referring to FIG. 13 showing a field-emission cathode in a cathode electron gun according to a fourth embodiment of the present invention, a micro-strip line pair is implemented as a distributed parameter transmission line pair having a strip line 12 formed on an insulation substrate 1 as a central conductor and a rear electrode 13 as a ground conductor. The input RF signal is transmitted via the micro-strip line pair to be applied between the gate electrode 23 and focusing electrode 25 in the cathode 2. The gate electrode 23 is connected to the rear electrode 13 via a gate electrode line 31. A step portion having a height equal to the overall thickness of the field-emission cathode 2 is formed on the surface of the insulating substrate 1, and the focusing electrode 25 and gate electrode 23 are connected with the respective lines on the same plane. A suitable impedance-matching element (not illustrated) is inserted in the micro-strip line to match the micro-strip line pair with the RF signal.

Figure 14:
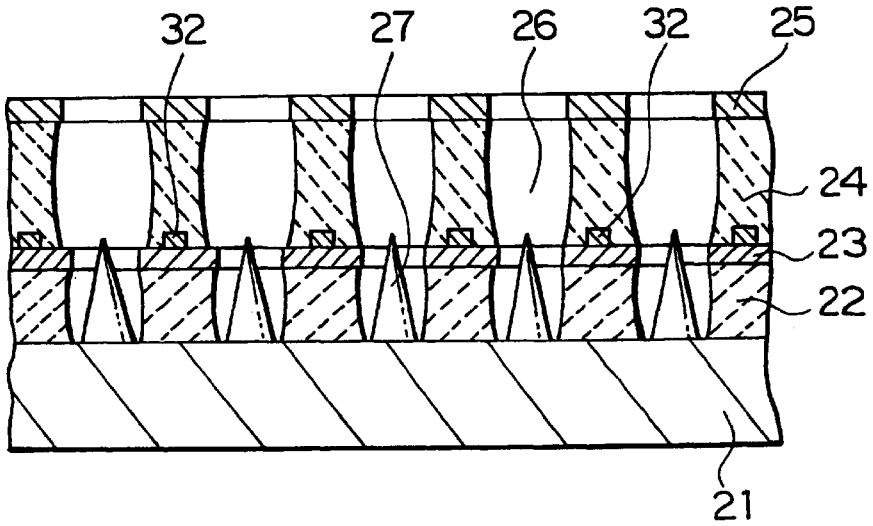
FIG. 14 is an enlarged cross-sectional view of the principal part of a field-emission cathode according to a fifth embodiment of the present invention.

Referring to FIG. 14 showing the principal part of a field-emission cathode in a cathode electron gun according to a fifth embodiment of the present invention, the present embodiment is similar to the first embodiment except for gate electrode projections 32 provided on the gate electrode layer 23 in the present embodiment. Each of the gate electrode projections 32 is of an annular configuration which encircles a corresponding opening of the gate electrode 23 and is electrically connected to the gate electrode 23 to have the same electric potential therewith. As shown in the figure, the tips of the emitters 27 are located at a level between the top and bottom of the gate electrode projections 32, or between the top of the projections 32 and the top surface of the gate electrode 23 other than the projections 32. By this configuration, the annular gate electrode projections 32 prevent the electric field around the tips of the emitters 27 from being lowered by the electric potential of the tips of the emitters 27, substantially without affecting the RF electric field between the gate electrode 23 and the focusing electrode 25.

Figure 15:
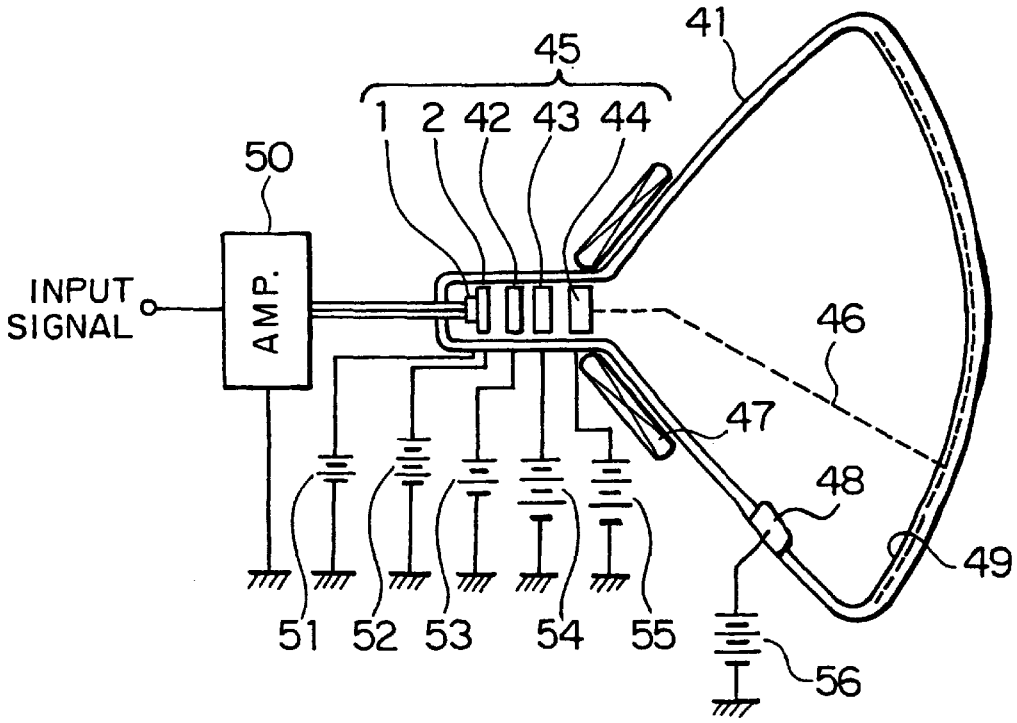
FIG. 15 is a cross-sectional view of a CRT as a sixth embodiment of the present invention.

Referring to FIG. 15 showing a CRT implemented as an image receiving tube according to a sixth embodiment of the present invention, an electron gun 45 disposed in a glass housing 41 comprises a field-emission cathode 2 and first to third focusing electrodes 42 to 44. DC voltages from power sources 51 to 56 are supplied to the cathode electrode of the field-emission cathode 2, the first to third focusing electrodes 42 to 44 and an anode 48, respectively. An electron beam 46 is generated by converging and accelerating the electrons emitted from the field-emission cathode 2. A signal for modulating the electron beam 46 is applied to the cathode 2 from an amplifier 50 receiving an input signal. The electron beam 46 is deflected in accordance with the current waveform applied to a deflecting yoke 47 to hit on a fluorescent screen 49.

In the CRT of the present embodiment, the electron beam 46 can be density-modulated at a high frequency, and an electron beam substantially without distortion can be obtained. Accordingly, the number of picture elements for displaying on the screen with a high resolution can be increased. Further, there is another advantage of low power-dissipation due to the absence of a heater.

Figure 16:
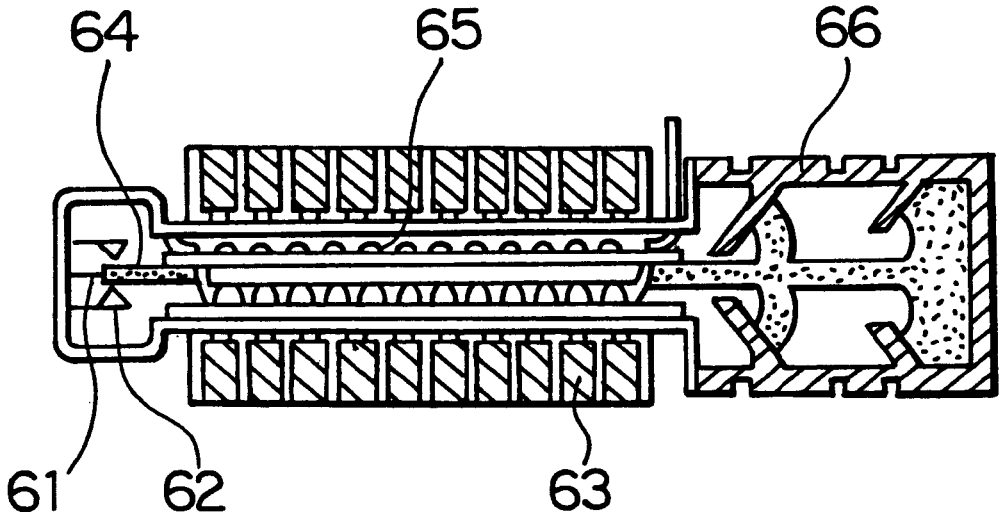
FIG. 16 is a cross-sectional view of a TWT as a seventh embodiment of the present invention.

Referring to FIG. 16, there is shown a TWT (travelling wave tube) according to a seventh embodiment of the preferred invention, which is a typical microwave tube implemented as an electron beam device having a field-emission cathode. Electrons emitted from the field-emission cathode 61 are converged by an electrostatic field produced by an electron gun 62 and a magnetic field produced by magnets 63 to form an electron beam 64 having a predetermined spot shape. The electron beam 64 passes through a helix 65 implemented as a low-speed circuit and having an inner diameter less than 1 mm to be collected by a collector 66. An input RF signal applied to the cathode 61 produces a density-modulated electron beam 64, which in turn induces a RF signal in the helix 65 by an interaction during passing through the helix 65. The induced RF signal is amplified to produce an output signal.

In a conventional TWT in which a RF signal is input directly to the helix 65, the electron beam is first velocity-modulated by the RF signal, and then density-modulated while drifting in the helix in which electrons are locally congregated. The input RF signal is amplified by an interaction between the RF signal travelling on the helix and the density-modulated electron beam.

On the other hand, the present embodiment does not require means for velocity-modulation and for drifting electrons, and accordingly, provides a density-modulated electron beam with a high modulation coefficient in the electron gun. In this configuration, the length of the helix can be largely reduced to realize a small-sized TWT. Further, a high RF-DC conversion efficiency can be attained in the TWT because of a large current density of the electron beam generated by the field-emission cathode.

In the seventh embodiment, the TWT has been described in which the helix is used as a slow wave circuit, however, the field-emission cathode according to the seventh embodiment can be also applied to a TWT having a coupling cavity or a ring loop, other than the helix configuration, to take advantages of the field-emission cathode according to the seventh embodiment.

In the present invention, the insulating substrate can be replaced by another substrate in which an insulation layer is formed on a metal plate or a semiconductor plate.

Since the above embodiments are described only for examples, the present invention is not limited to the above embodiments and various modifications or alterations can be easily made therefrom by those skilled in the art without departing from the scope of the present invention.

What is claimed is:

1. A field-emission cathode electron gun comprising:

a substrate having a conductive surface;

a first insulation film, a gate electrode, a second insulation film and a focusing electrode consecutively formed on said conductive surface and defining a plurality of cavities therein; and an emitter formed on said conductive surface in each of said cavities to emit an electron beam from a tip of said emitter, said tip of said emitter being disposed at a level between a top surface of said gate electrode and said focusing electrode, said gate electrode and focusing electrode receiving therebetween a signal for modulating said electron beam and further wherein said gate electrode has an annular projection disposed on and above said gate electrode encircling a corresponding one of said cavities.

2. A field-emission cathode electron gun comprising:

a substrate having a conductive surface;

a first insulation film, a gate electrode, a second insulation film and a focusing electrode consecutively formed on said conductive surface and defining a plurality of cavities therein; and an emitter formed on said conductive surface in each of said cavities to emit an electron beam from a tip of said emitter, said tip of said emitter being disposed at a level between a top surface of said gate electrode and said focusing electrode, said gate electrode and focusing electrode receiving therebetween a signal for modulating said electron beam, and further wherein said gate electrode and focusing electrode implement a pair of distributed parameter transmission lines.

3. A field-emission cathode electron gun comprising:

a substrate having a conductive surface;

a first insulation film, a gate electrode, a second insulation film and a focusing electrode consecutively formed on said conductive surface and defining a plurality of cavities therein; and an emitter formed on said conductive surface in each of said cavities to emit an electron beam from a tip of said emitter, said tip of said emitter being disposed at a level between a top surface of said gate electrode and said focusing electrode, said gate electrode and focusing electrode receiving therebetween a signal for modulating said electron beam, further comprising a pair of distributed parameter transmission lines connected to said gate electrode and focusing electrode, respectively.

4. A field-emission cathode electron gun comprising:

a substrate having a conductive surface;

a first insulation film, a gate electrode, a second insulation film and a focusing electrode consecutively formed on said conductive surface and defining a plurality of cavities therein; and an emitter formed on said conductive surface in each of said cavities to emit an electron beam from a tip of said emitter, said tip of said emitter being disposed at a level between a top surface of said gate electrode and said focusing electrode, said gate electrode and focusing electrode receiving therebetween a signal for modulating said electron beam; and further comprising a third insulation film disposed between said focusing electrode and said second insulation film, wherein said third insulation film has a depression for exposing said plurality of cavities.

5. A field-emission cathode electron gun comprising:

a substrate having a conductive surface;

a first insulation film, a gate electrode, a second insulation film and a focusing electrode consecutively formed on said conductive surface and defining a plurality of cavities therein; and an emitter formed on said conductive surface in each of said cavities to emit an electron beam from a tip of said emitter, said tip of said emitter being disposed at a level between a bottom surface of said gate electrode and said focusing electrode, said gate electrode and focusing electrode receiving therebetween a signal for modulating said electron beam and further wherein said gate electrode has an annular projection disposed on and above said gate electrode encircling a corresponding one of said cavities.

6. A field-emission cathode electron gun as defined in claim 5 wherein said tip of said emitter is located at a level between the top and bottom of said annular projection.

7. An electron beam device having a field-emission cathode, the cathode comprising:

a field-emission cathode electron gun comprising:

a substrate having a conductive surface;

a first insulation film, a gate electrode, a second insulation film and a focusing electrode consecutively formed on said conductive surface and defining a plurality of cavities therein; and an emitter formed on said conductive surface in each of said cavities to emit an electron beam from a tip of said emitter, said tip of said emitter being disposed at a level between a top surface of said gate electrode and said focusing electrode, said gate electrode and focusing electrode receiving therebetween a signal for modulating said electron beam and further wherein said gate electrode has an annular projection disposed on and above said gate electrode encircling a corresponding one of said cavities.

* * * * *